US006280366B1

(12) United States Patent
Hsieh

(10) Patent No.: US 6,280,366 B1
(45) Date of Patent: Aug. 28, 2001

(54) MULTI-PURPOSE SLIDING EXERCISER

(76) Inventor: Jung-Pao Hsieh, No. 64, Lane 289, Geen Yuan Ro., Chungli City, Taoyuan Hsien (TW)

( * ) Notice: Subject to any disclaimer, the term of this patent is extended or adjusted under 35 U.S.C. 154(b) by 0 days.

(21) Appl. No.: 09/525,279

(22) Filed: Mar. 14, 2000

(51) Int. Cl.[7] ..... A63B 23/04
(52) U.S. Cl. ..... 482/130; 482/71; 482/51
(58) Field of Search ..... 482/51, 72, 71, 482/907, 130, 79, 70, 92–94

(56) References Cited

U.S. PATENT DOCUMENTS 3,856,321 * 12/1974 Solymosi ..... 280/87.06
4,340,214 * 7/1982 Schutzer ..... 482/51
5,209,711 * 5/1993 Scrima ..... 482/70
5,279,532 * 1/1994 Chen ..... 482/71
5,328,427 * 7/1994 Sleamaker ..... 482/71
5,503,609 * 4/1996 Bull ..... 482/907
5,520,598 * 5/1996 Little ..... 482/79

* cited by examiner

*Primary Examiner*—Jerome Donnelly
(74) *Attorney, Agent, or Firm*—Pro-Techtor International Services

(57) ABSTRACT

A multi-purpose sliding exerciser including a base made of two boards butted and hinged to each other. The hinge joint is threaded with a plurality of elastic ropes. At each end of the base is a tension rope. A plurality of insertion holes are also provided in pairs on the base to restrict the pedals' slide path. The multipurpose sliding exerciser allows the user to remove the elastic ropes threaded through the back side of the base so as to fold up the boards for easy storage or transport.

4 Claims, 12 Drawing Sheets

MULTI-PURPOSE SLIDING EXERCISER

BACKGROUND OF THE INVENTION

1. Field of the Invention

The present invention relates to a multi-purpose sliding exerciser, and more particularly, to an exerciser that permits a basic sliding movement and various types of extension movement. The boards forming the body of the exerciser can be folded to facilitate storage or transport.

2. Description of the Prior Art

Most exercisers available in the market involve coordination of muscles to achieve health effects or building up one's body. Among those exercisers, there is a type of sliding exerciser that allows lateral sliding movement. The sliding exerciser is comprised of a board, guiding rails formed on the board, and a pair of pedals provided with rollers underneath. However, to achieve the desired purpose, the span for both feet to move outward is critical. Therefore, the board must be of a certain length to meet the minimum span required. As a result, the sliding exerciser is not only awkward to carry along, but also takes a large storage space. Furthermore, by providing only sliding movement by the legs, the sliding exerciser fails to attract users.

SUMMARY OF THE INVENTION

The primary objective of the present invention is to provide a multi-purpose sliding exerciser comprised of a base made of two boards butted and hinged to each other. The hinge joint is threaded with a plurality of elastic ropes. At each end of the base is a tension rope. A plurality of insertion holes are also provided in pairs on the base to restrict the pedals'slide path.

Another purpose of the present invention is to provide a multipurpose sliding exerciser that allows the user to remove the elastic ropes threaded through the back side of the base so as to fold up the boards for easy storage or transport.

DETAILED DESCRIPTION OF THE INVENTION

Figure 1:
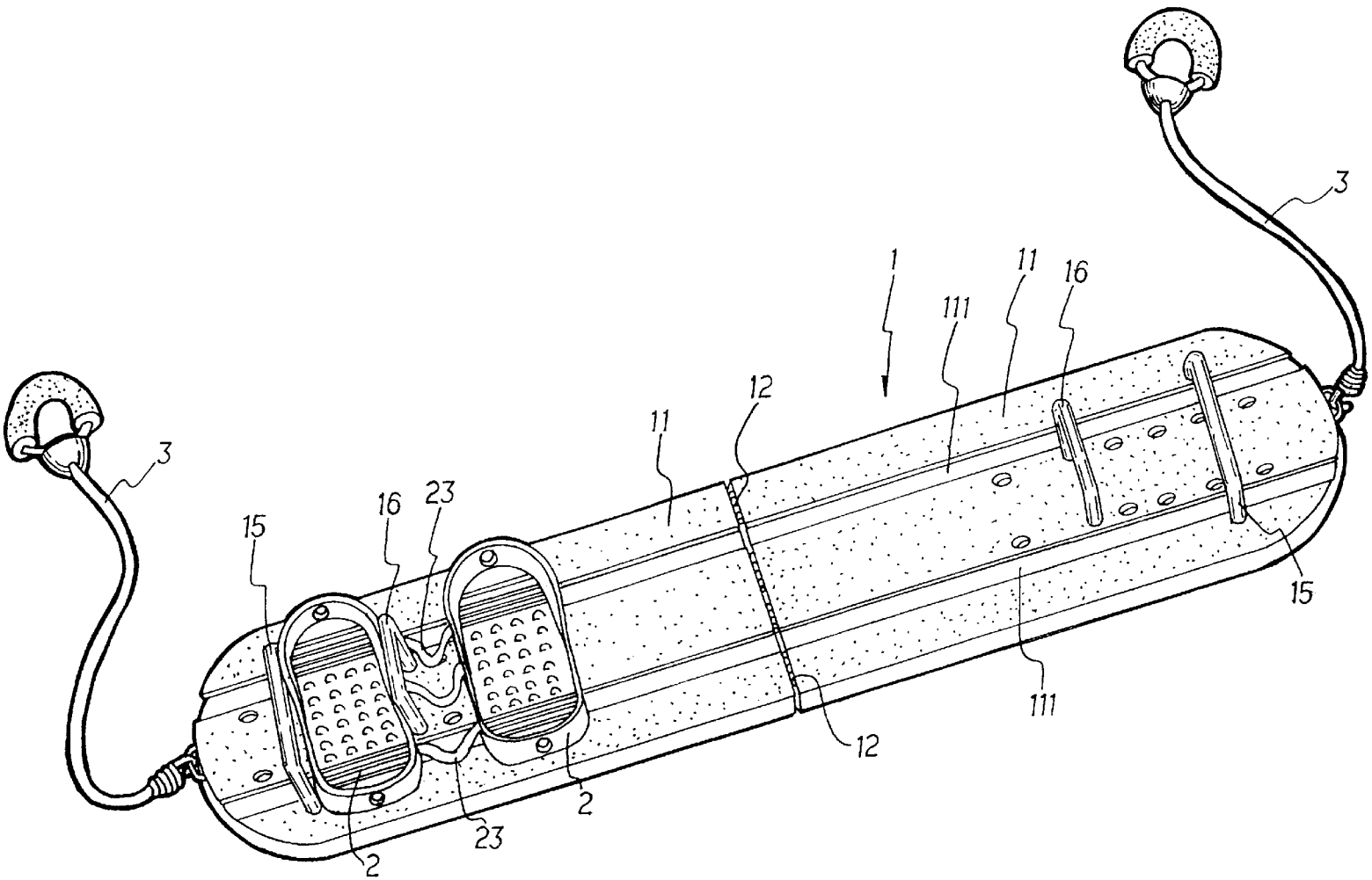
FIG. 1 is a perspective view of a preferred embodiment of the present invention.
Figure 2:
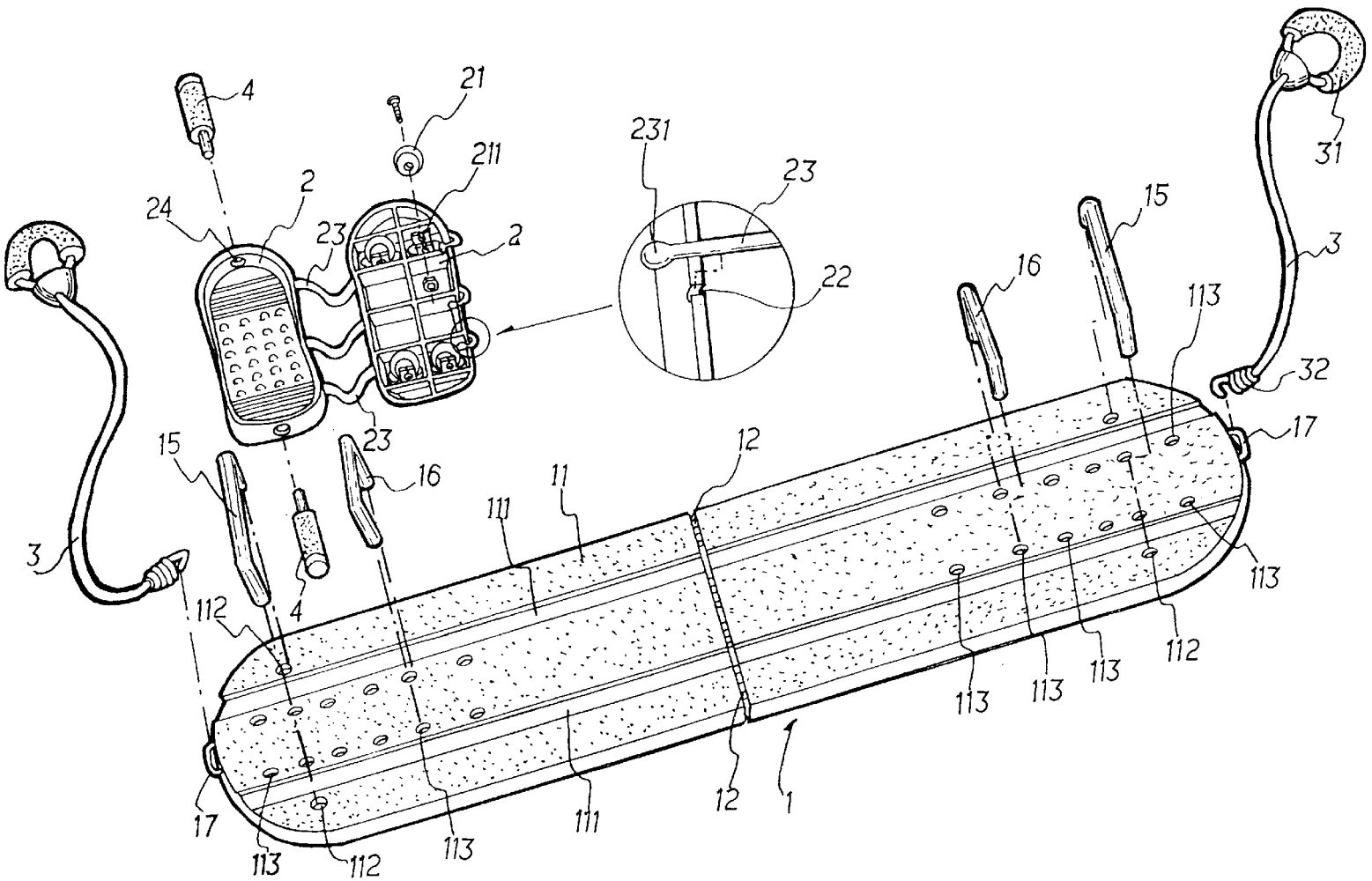
FIG. 2 is an exploded view showing the structure of the present invention.

Referring to FIGS. 1 and 2, the present invention comprises a base board (1) as the body, two guiding rails (111) formed on the base board (1) and a pair of pedals (2) provided with rollers (21) that roll in the rails (111). The base board (1) includes two boards (11) joined by a hinge (12). The pair of guiding rails on each board (11) also aligns with each other to form the continuous guiding rails (111) for the base board (1).

Figure 3:
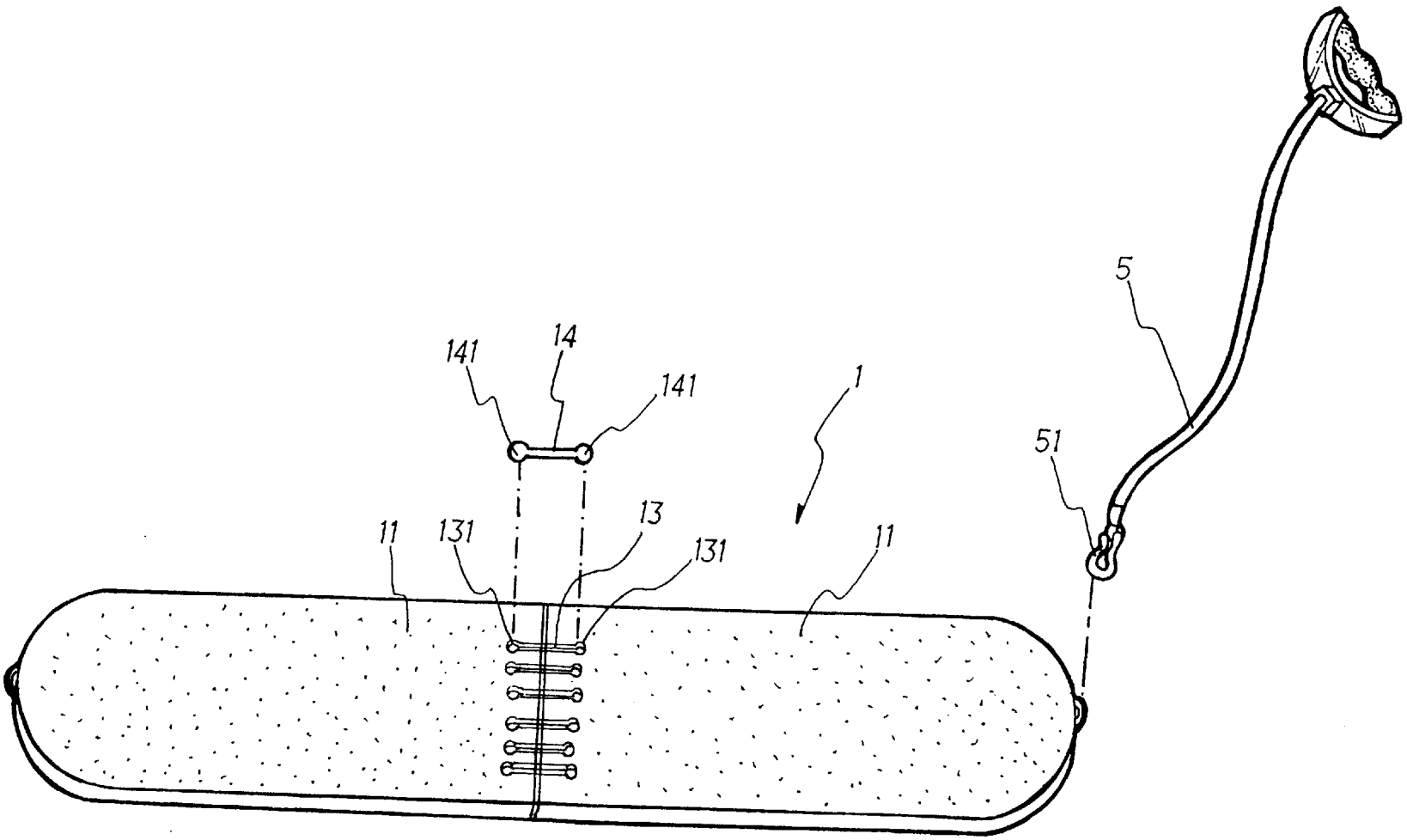
FIG. 3 is an exploded view showing the backside of the baseboard of the present invention.

As illustrated in FIG. 3, a plurality of slots (13) are provided on the back side of the boards (11) at the hinged joint. At both ends of slots (13), a hole (131) larger in diameter than the width of the slot (13) is provided to facilitate the threading of an elastic rope (14) into the slot (13), with both ends (141) of the elastic rope (14) respectively fitting into the holes (131). Furthermore, at both ends of the base board (11), an eyelet (17) is fixed to receive a tension rope (3) comprised of a handle ring (31) and a hook (32). The hook (32) hooks the tension rope (3) to the eyelet (17) on the board (11) so as to allow both ends of the baseboard (1) to form a base for the tension rope (3).

A pair of openings (112) is provided at each end of the board (11) to receive a stop (15). The stops (15) prevent the pair of pedals (2) from falling out of the guiding rails (111) on the base board (1). Multiple pairs of regulation openings (113) are also provided at a proper spacing on the board (11) as options for the insertion of second stops (16) depending on the sliding range of the pair of pedals (2) on the base board (1) desired by the user.

On the inner edge of each of the pedals (2) is a plurality of eyelets (22) to receive elastic ropes (23) to thread by fixing ends (231) so as to connect both pedals (2). A key hole (24) is provided at both ends of the pedal (2) to receive a handle (4) for the pedal (2). A slot (114) is formed on each wall of the guiding rail (111) of the base board (1).

Figure 4:
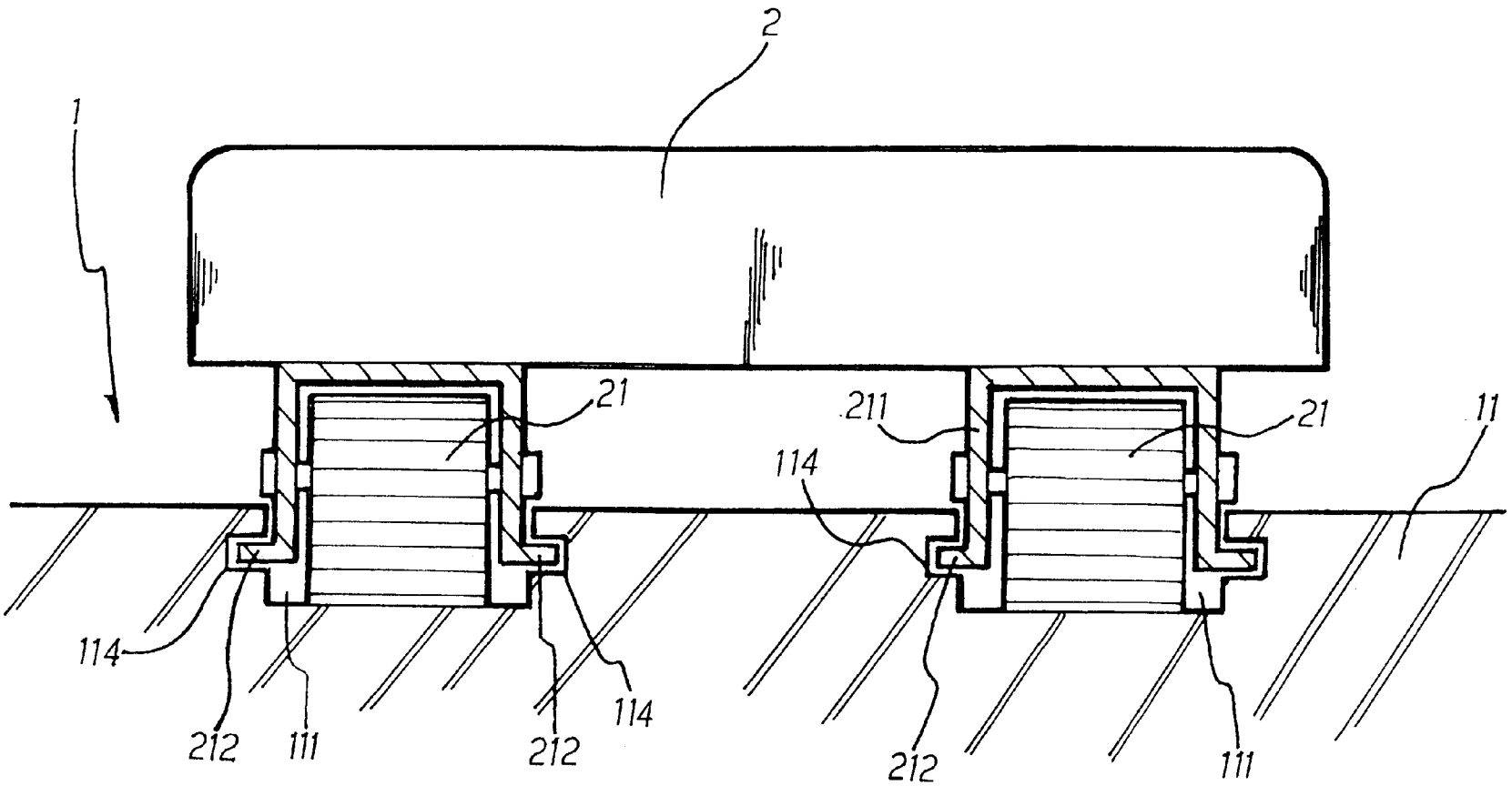
FIG. 4 is a sectional view showing the pedals and the guiding rails on the baseboard.

A protrusion edge (212) provided on both ends of a roller frame (211) of the roller (21) of the pedal (2) is received in slot (114) of the guiding rail (111) as illustrated in FIG. 4.

This prevents derailment of the pedal (2).

Figure 5A:
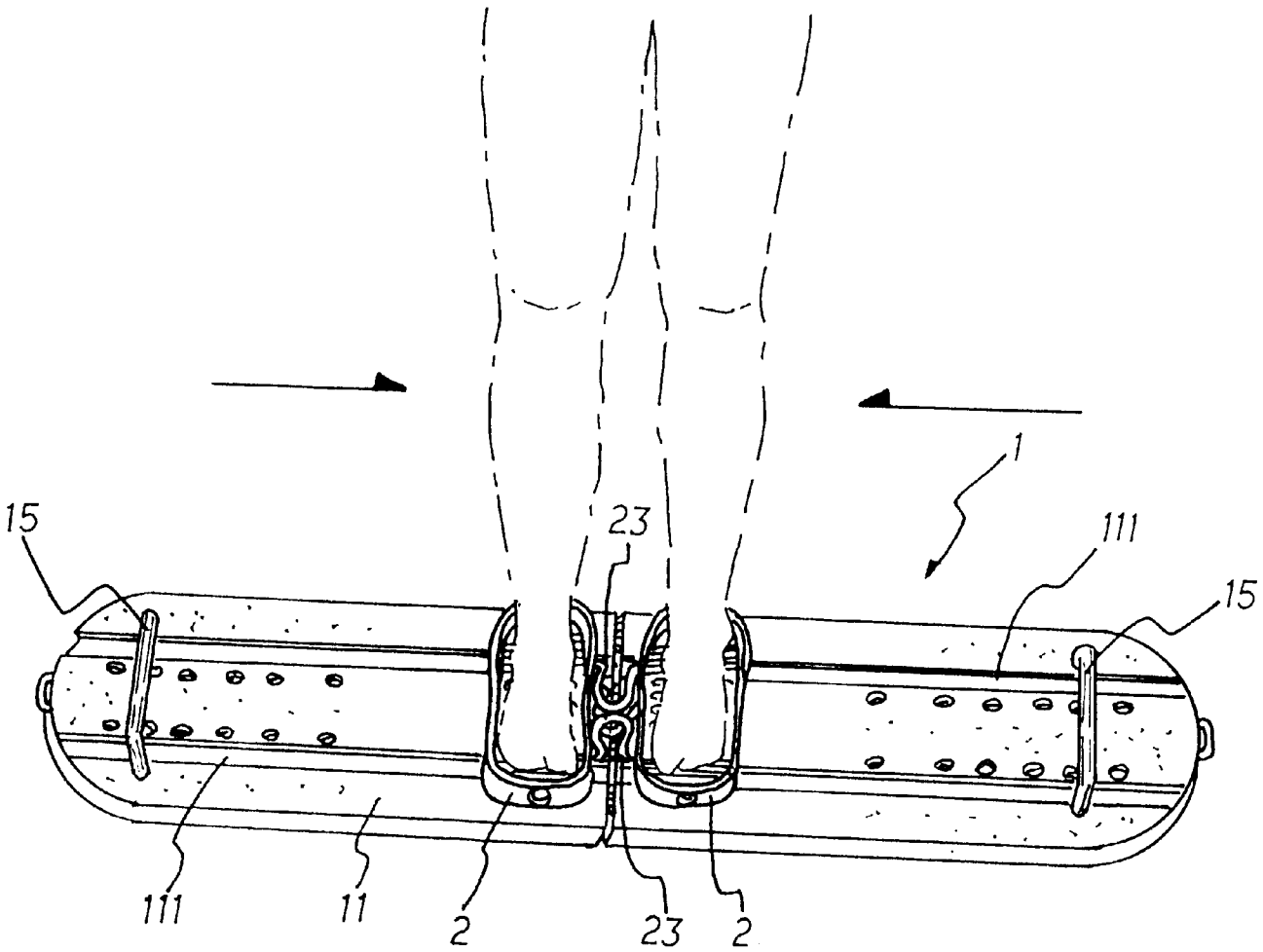
FIGS. 5A and 5B are schematic views showing the sliding movement with both feet sliding.
Figure 5B:
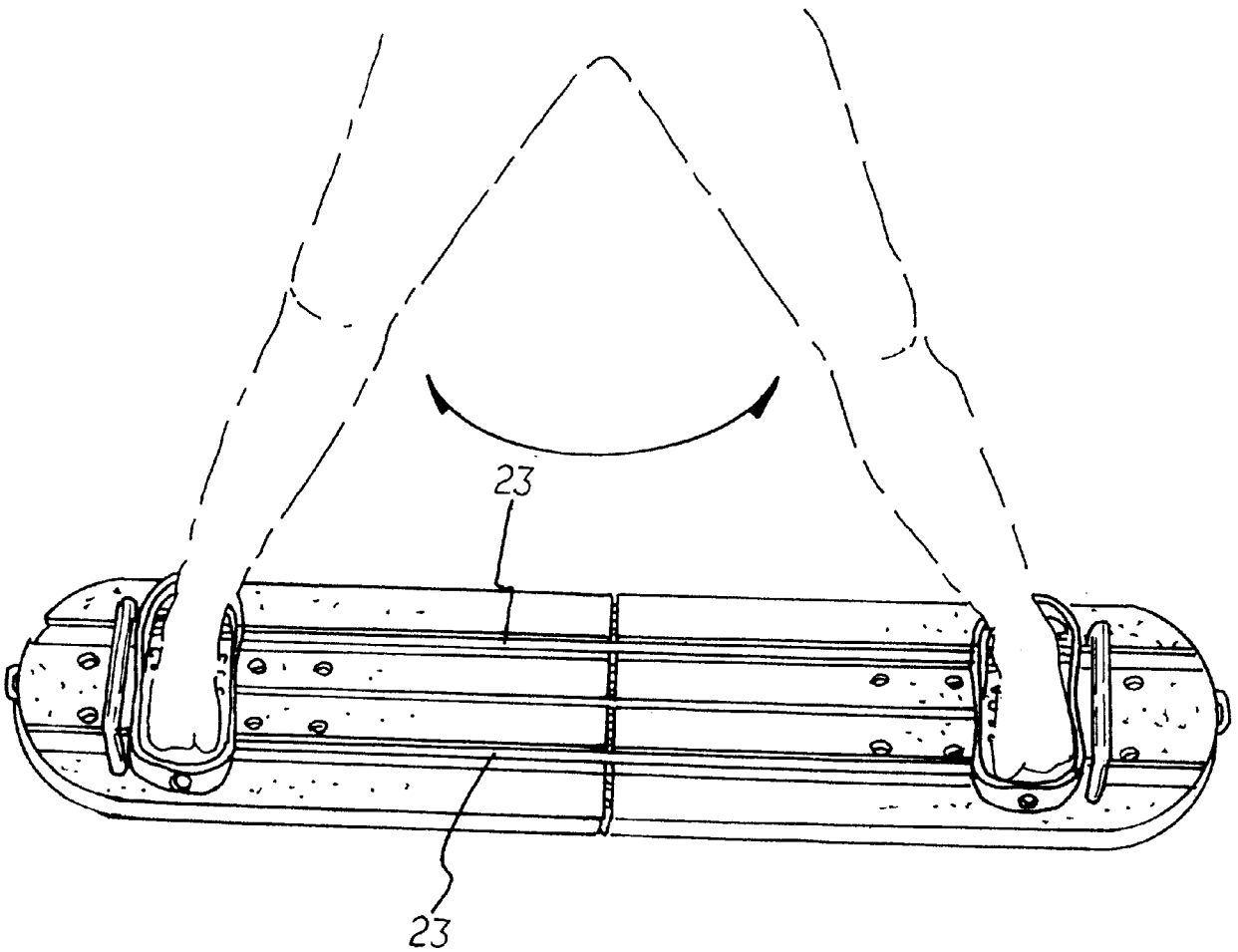
Figure 6A:
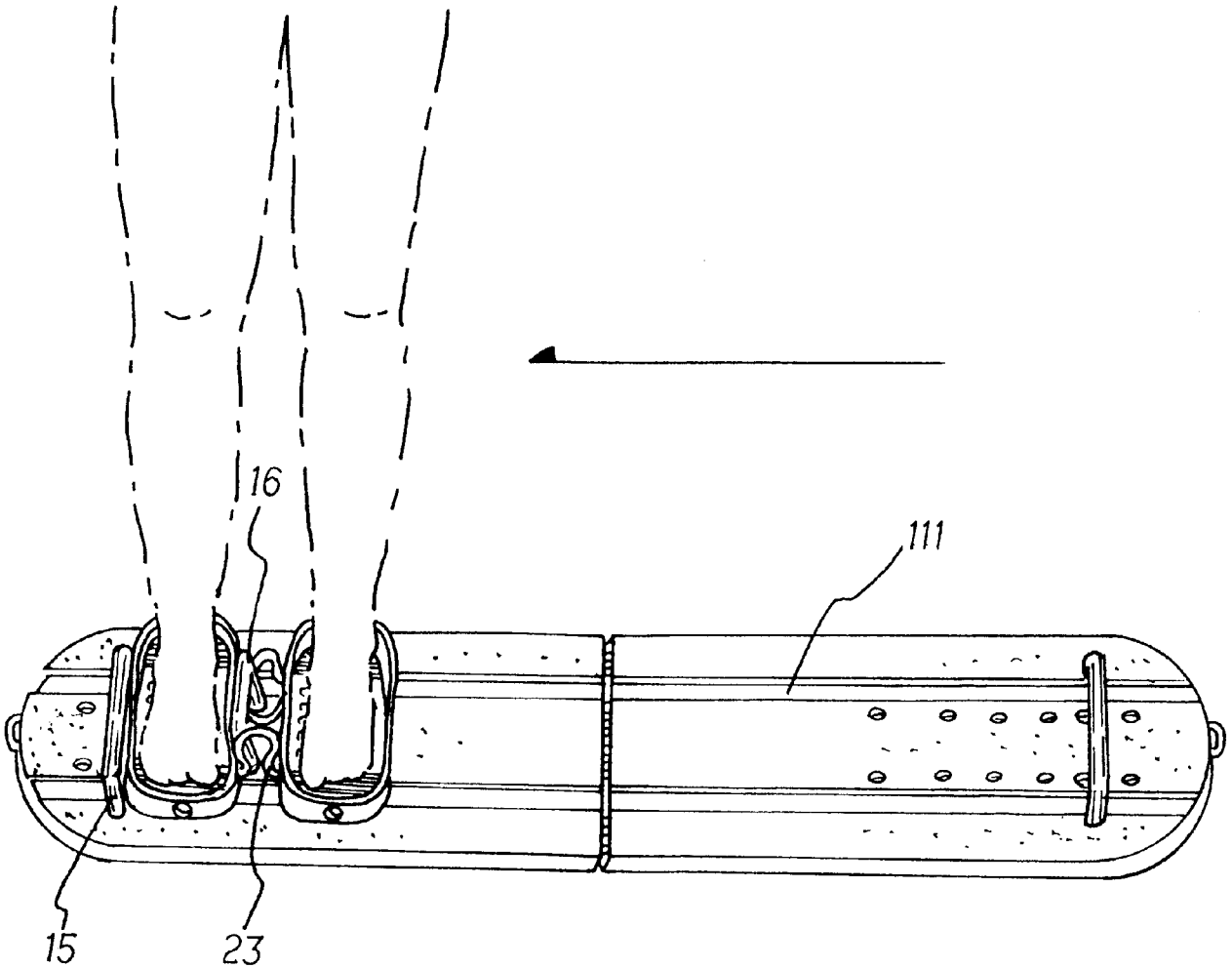
FIGS. 6A and 6B are schematic views showing the sliding movement with one foot sliding.
Figure 6B:
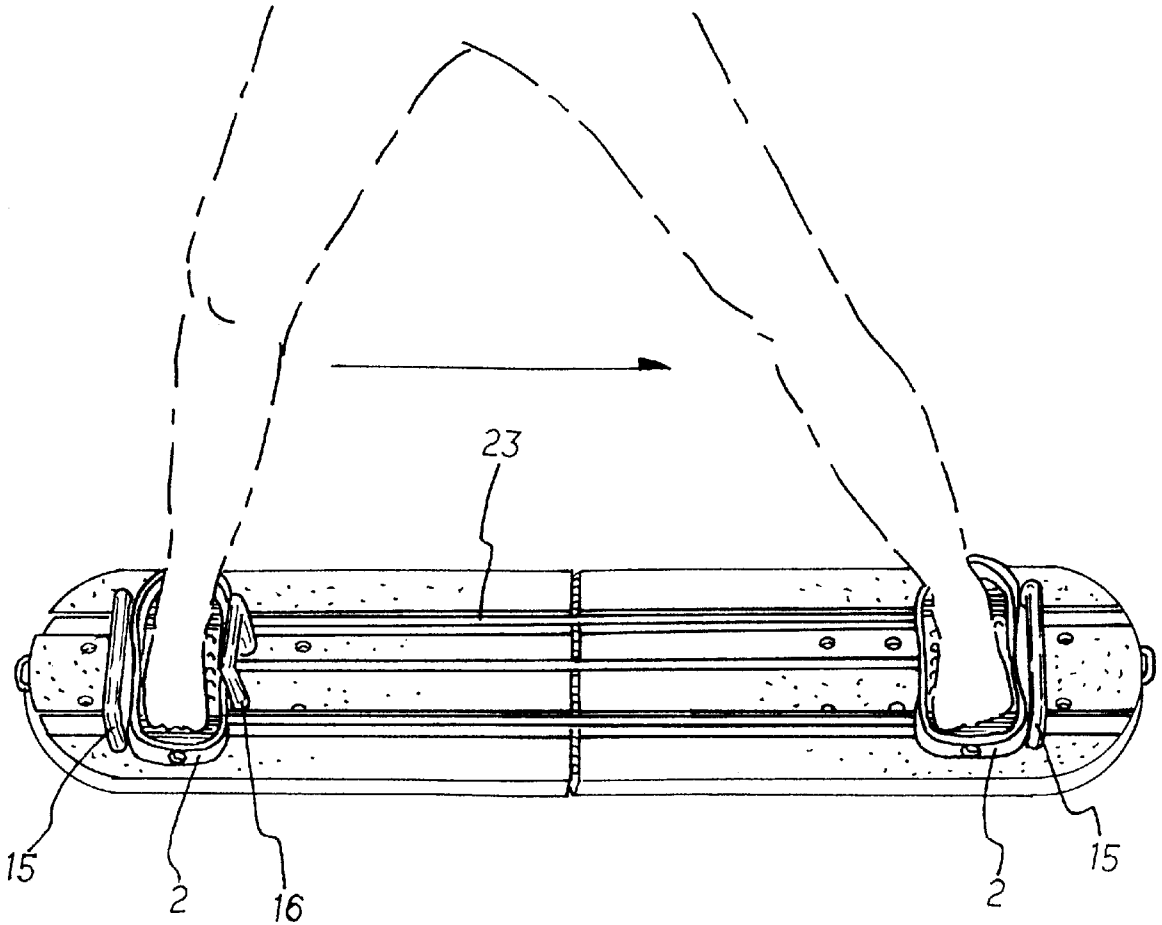

Now referring to FIGS. 5A and 5B, the present invention permits a sliding movement for a user to work out. Depending on individual physical conditions the user may select the proper number of elastic ropes (23) to thread between the pedals (2) to create a resistance/restoration force. The user then steps on the pedals, and spreads his feet toward the ends of the base board (1). Also as illustrated in FIGS. 6A and 6B, the stop (16) can be used to fix one pedal in position. Protrusions provided on the surface of the pedal (2) provides a plantar massaging action.

Figure 7:
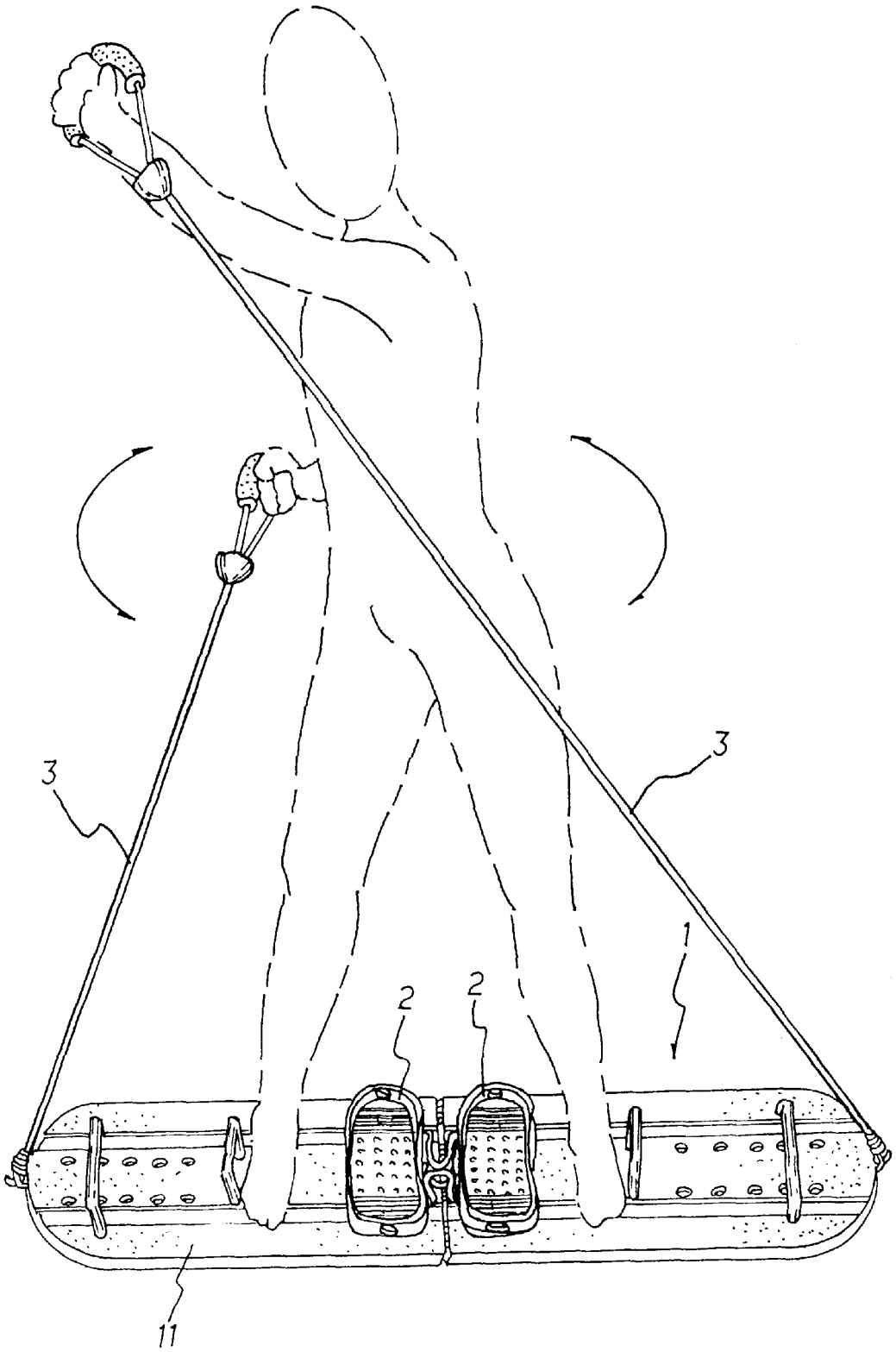
FIG. 7 is a view showing another exercise.
Figure 8:
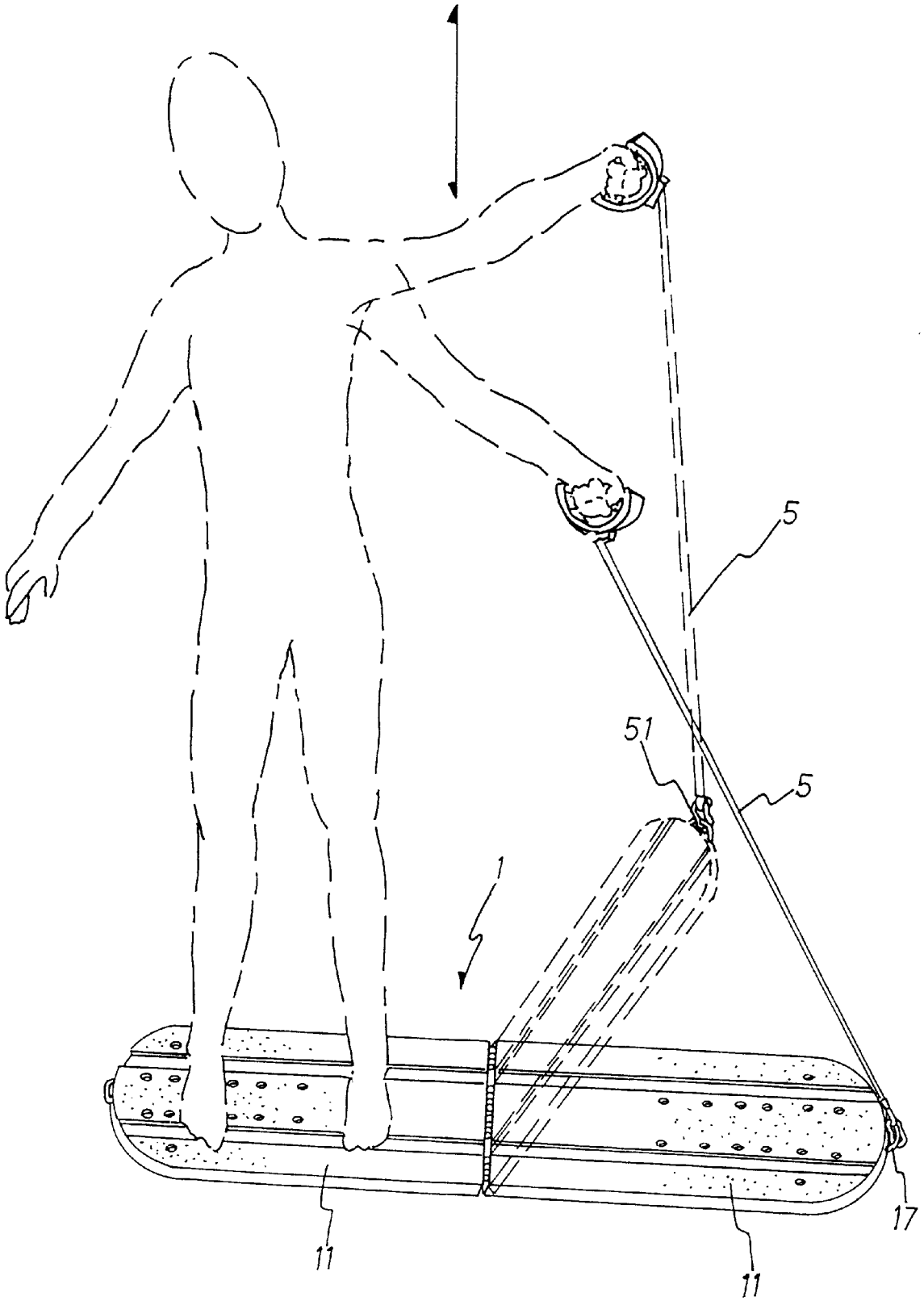
FIG. 8 is a view showing another exercise.

As illustrated in FIG. 7, in another exercise, the user steps on the boards (11) of the base board (1) and with both hands pulls the tension ropes (2) fixed onto the base board (1). This allows the user to work out by twisting his waist in conjunction with stretching. Furthermore, as illustrated in FIG. 8, the user may stand on either of the boards (11) of the base board (1), then mount a rope (5) without elasticity to replace the tension rope (3). The rope (5) is attached by its ring (51) in the eyelet (17) provided on the other board (11). As the user raises and lowers the rope (5), the other board (11) folds at the hinge (12). Depending on the individual requirements, if a heavier work out is desired for the arm, the drawing force may be adjusted by increasing the number of the elastic ropes (15) provided at the bottom of the board (11). Meanwhile, the force to lift up the board may also be adjusted by changing the number of the elastic ropes (14) binding both boards (11).

Figure 9:
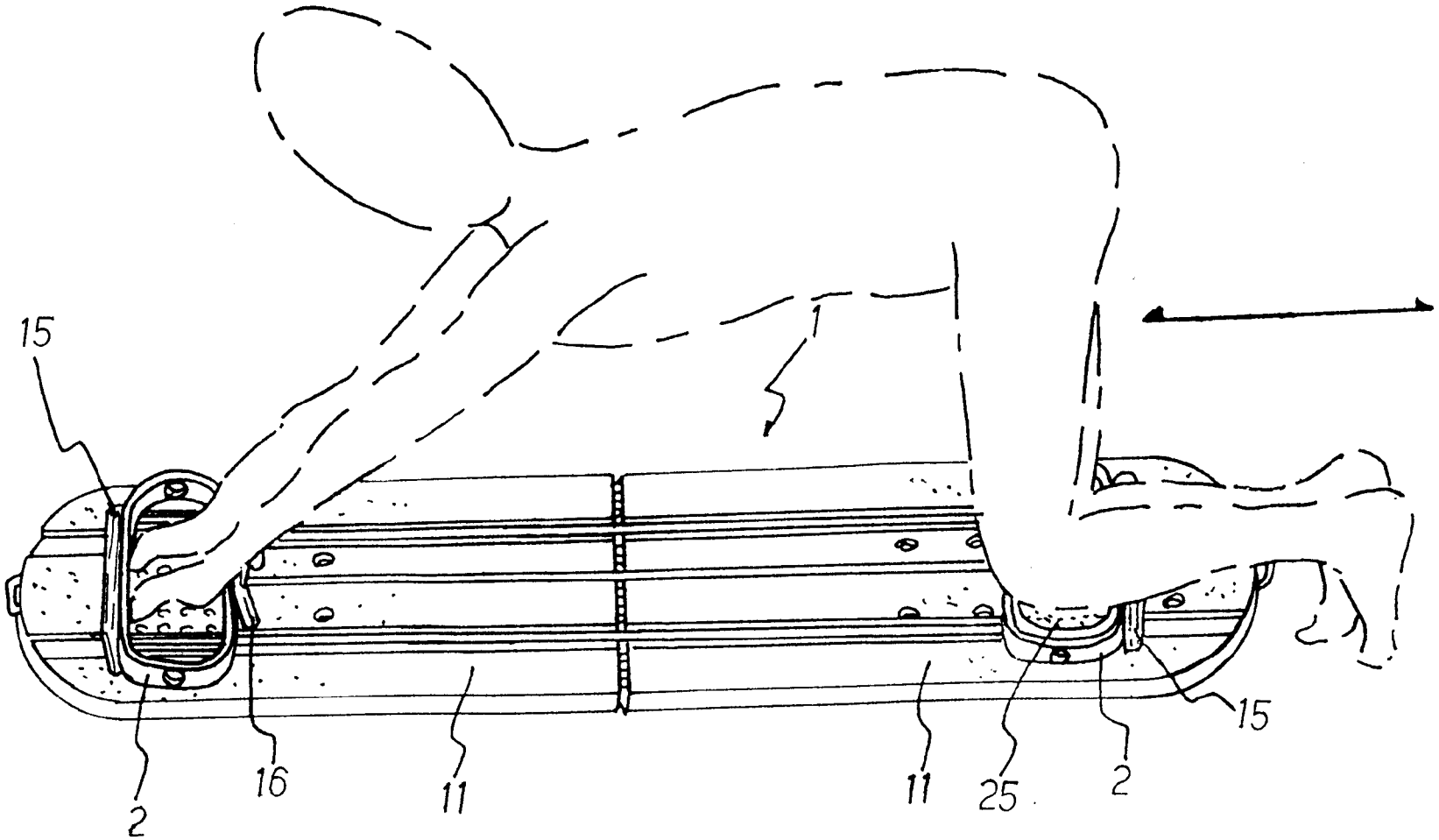
FIG. 9 shows a kneeling exercise.
Figure 10:
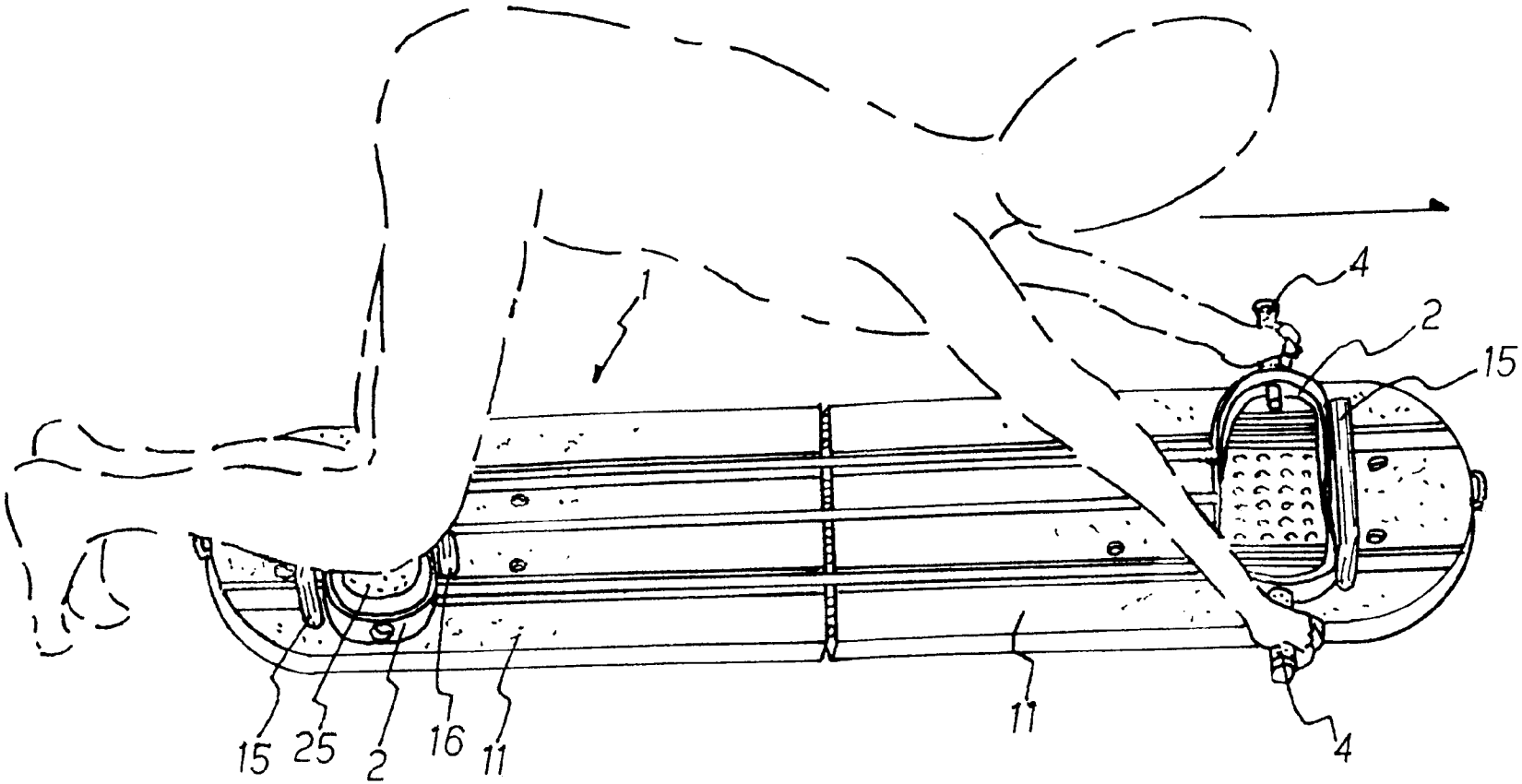
FIG. 10 shows another kneeling exercise.

As illustrated in FIG. 9, the user may fix either pedal (2) with the stops (15, 16), kneel down on the other pedal (2) which is mobile, and place both hands on the fixed pedal (2) to stretch the body to work out the abdomen. To protect the knees, a cushion (25) may be provided on the mobile pedal (2). The user may in the same posture hold onto both handles (4) provided on the fixed pedal (2).

When the exerciser of the present invention is not in use, all components and elastic ropes binding both boards (11) may be removed from the base board (1) to fold up both boards (11) to reduce its length to half of the original length for facilitating storage or transport.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A multi-purpose sliding exerciser, comprising:

a base board, guiding rails on the base board, and a pair of pedals provided with rollers, said rollers being received and contained in said guiding rails to allow said pedals to slide on said base board; wherein said base board is comprised of two boards joined with a hinge, said boards are connected by with a plurality of elastic ropes spanning said hinge, an eyelet is provided at each end of said base board to receive a tension rope, a pair of fixing openings are provided on each board near a distal end of said board, multiple pairs of regulation openings are spaced on said base board, said regulation openings receive at least one stop so as to restrict the glide path of said two pedals, and said pedals are bound together with a plurality of elastic ropes, and each pedal includes at least one hole to receive a handle therein.

2. The multi-purpose sliding exerciser as claimed in claim 1, wherein:

each pedal is provided with a plurality of eyelets to receive said elastic ropes that bind said pedals together.

3. The multi-purpose sliding exerciser as claimed in claim 1, wherein:

a slot is formed in both walls of said guiding rails on said base board, said slots receive protrusions formed on said rollers so as to secure said rollers in said guiding rails, thereby ensuring that said pedals remain on said base board.

4. The multi-purpose sliding exerciser as claimed in claim 2, wherein:

a slot is formed on both walls of the guiding rails on the base board so to permit the insertion into the corresponding of the ditch of guiding rail to prevent detail by the pedal.

* * * * *